United States Patent [19]

Fox et al.

[11] 3,940,722

[45] Feb. 24, 1976

[54] REED SWITCH RELAY

[75] Inventors: Thomas E. Fox, Park Ridge; John W. Scannell, Glenview; Clifford H. Andersen, Park Ridge, all of Ill.

[73] Assignee: C. P. Clare & Company, Chicago, Ill.

[22] Filed: Nov. 8, 1974

[21] Appl. No.: 521,951

[52] U.S. Cl. ..... 335/151; 335/202

[51] Int. Cl.[2] ..... H01H 50/02

[58] Field of Search ..... 335/151, 152, 153, 154, 335/202; 336/192, 208

[56] References Cited

UNITED STATES PATENTS

| | | | |
|---|---|---|---|
| 3,171,918 | 3/1965 | Killion | 335/152 |
| 3,359,395 | 12/1967 | Bruce | 335/152 X |
| 3,434,079 | 3/1969 | Ege | 335/151 |
| 3,760,311 | 9/1973 | Zimet et al. | 335/152 |

*Primary Examiner*—G. Harris

*Attorney, Agent, or Firm*—Mason, Kolehmainen, Rathburn & Wyss

[57] ABSTRACT

A reed switch relay includes an elongated bobbin surrounding a reed switch having a pair of axially extending leads. Supporting members extend longitudinally from opposite ends of the bobbin for mounting the bobbin to a circuit board, and resilient members for retaining the leads of the reed switch are integrally molded into the supporting members. The leads of the reed switch are bent downwardly and engage the resilient retaining members with a snap action. The downwardly extending ends of the leads protrude from the retaining members and serve as connecting pins for mounting the relay assembly to a circuit board or a socket.

12 Claims, 6 Drawing Figures

REED SWITCH RELAY

This invention relates generally to electromechanical relays, and more particularly to miniature sealed contact relays of the type employing magnetic reed switches.

When a reed switch is used in a relay assembly, apparatus is provided for supporting the reed switch and for providing electrical contact to the leads of the reed switch. Because reed switches are typically encased in a fragile glass envelope, the supporting structure should protect the envelope from breakage.

Several types of reed switch relay assemblies are used for mounting reed switches. Known systems generally employ a bobbin having an electromagnetic coil wound thereon. The reed switch is positioned within the bobbin and is supported by conductive supporting members soldered to leads extending from the reed switch. Alternatively, the leads of the reed switch may be bent and soldered to a circuit board. Typical prior art reed switch mounting assemblies are described in U.S. Pat. Nos. 3,167,625, 3,387,240 and 3,707,690.

While prior art systems provide ways for mounting a reed switch within a reed relay assembly, the prior art systems either do not provide adequate support for the reed switch, or require a rather complex mounting structure. For example, in the U.S. Pat. No. 3,167,625, the leads of the reed switch are secured by a resin, and in the 3,707,690 patent, they are secured by special terminal rings. In the 3,387,240 patent the leads are supported, but not secured.

An object of the present invention is to provide improvements in reed switch assemblies and in the method of assembling reed switches and to overcome disadvantages of known assemblies and methods.

Another object of the invention is to provide a reed switch relay assembly wherein the reed switch is supported and secured within a bobbin without the use of separate securing members.

It is another object of the present invention to provide a reed switch relay wherein the leads of the reed switch serve as connecting pins for making electrical connection to the contacts of the relay assembly.

A further object of the present invention is to provide a reed switch relay that is easily and quickly assembled.

In accordance with a preferred embodiment of the invention, there is provided a relay assembly having an elongated bobbin formed from an insulating material. A pair of supporting members extend from the ends of the bobbin, and a wire trap is molded into each of the supporting members. A reed switch mounted within the bobbin includes leads bent to engage the wire traps. The wire traps grip the leads with a snap action and retain the reed switch within the bobbin. The ends of the leads protrude from the wire traps, and serve as connecting pins or leads for attaching the relay assembly to a circuit board or socket.

An electromagnetic winding is wound around the bobbin for energizing the reed switch. Pins are inserted into the supporting members to provide contact pins for the electromagnetic winding. A shield is disposed over the bobbin to protect the electromagnetic coil and the reed switch leads from damage.

The above and other objects and advantages of the present invention will appear from the following detailed description of the invention in connection with which reference is made to the accompanying drawings, wherein.

Figure 1:
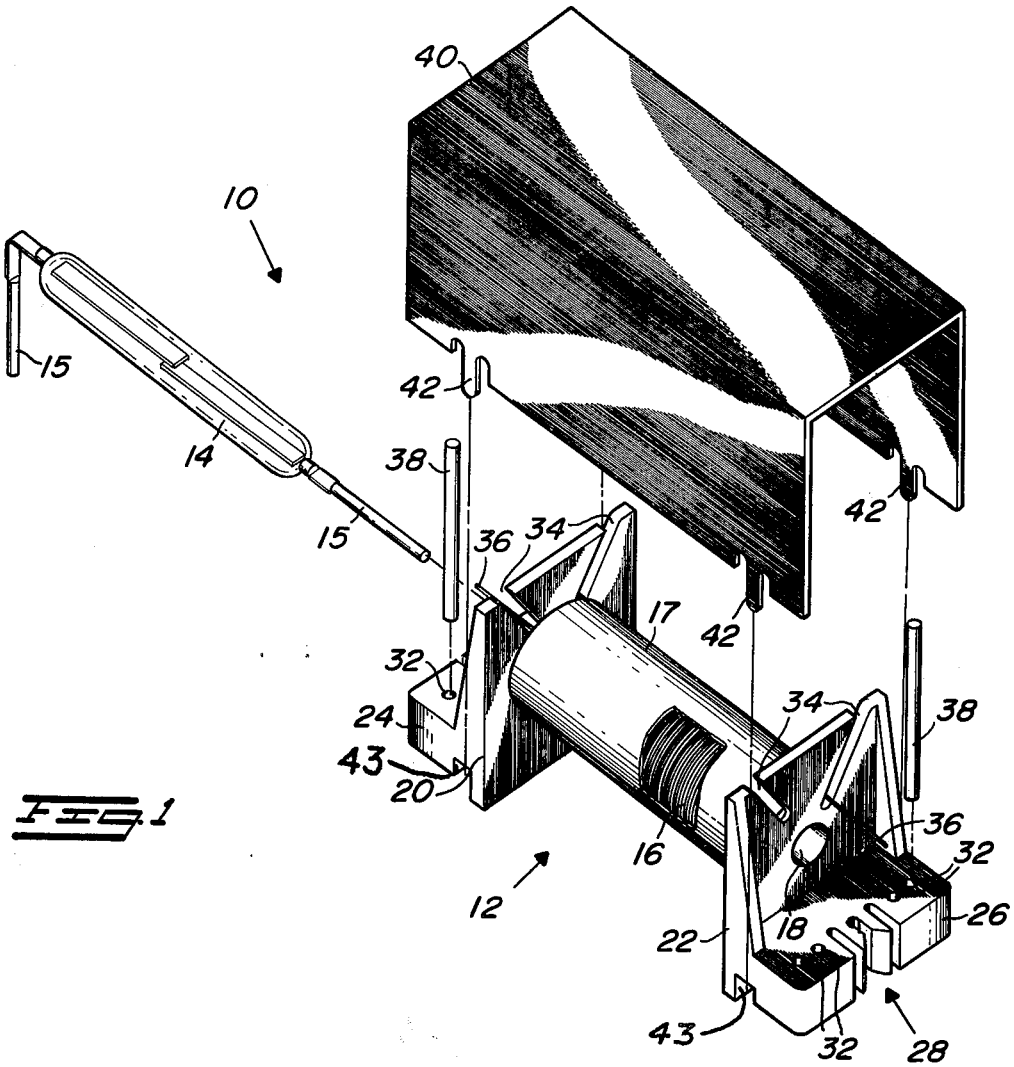
FIG. 1 is an exploded perspective view of a reed switch relay according to the invention.

Referring now to the drawings, and with particular reference to FIG. 1, there is shown a reed switch relay assembly designated in its entirety by the reference numeral 10. In general, the assembly 10 includes a bobbin 12 and a reed switch 14. In accordance with an important feature of the invention, wire traps 28 are integrally molded with the bobbin 12 for securing a pair of leads 15 extending from the reed switch 14 in order to provide the advantages of a simplified solderless strain relief for securing a pair of connecting pins to the bobbin 12.

The leads 15 of the reed switch 14 are bent downwardly for engaging the wire traps 28. In the embodiment shown, the leads are bent at a 90° angle, but the angle may be varied to suit the particular structure used. A portion of each of the pins 15 extends downwardly from the wire traps 28 and serves as a contact pin for making electrical contact with the reed switch 14. The downwardly extending pins 15 may be inserted into a printed circuit board or a socket, thereby eliminating the need for separate securing pins to be affixed to the bobbin 12.

An electromagnetic coil 16 is wound around the bobbin 12 and a protective covering 17 is wrapped around the coil 16. The electromagnetic coil 16 serves to generate a magnetic field between the contacts of the reed 16 for closing the contacts when the coil 16 is electrically energized. The reed switch 14 is inserted into an opening 18 extending coaxially through the bobbin 12. A pair of flanges 20 and 22 are molded integrally with the bobbin 12 and a pair of supporting legs 24 and 26 are molded integrally with the flanges 20 and 22, respectively. The traps 28 are molded into the supporting legs 24 and 26 and a plurality of holes 32 are formed in each of the legs 24 and 26. A pair of slots 34 is formed in each of the flanges 20 and 22. The slots 34 permit a lead 36 from the coil 16 to pass through the flange 22. The leads 36 are soldered or otherwise secured to a pair of posts 38, and each of the posts 38 is inserted into one of the holes 32. A protective cover 40, fabricated from sheet metal or the like, is disposed over the bobbin 12 and supported by the flanges 20 and 22. A series of protrusions 42 extend from the cover 40 for securing the cover 40 to slots 43 molded in the supporting legs 24 and 26 or to a printed circuit board or similar surface supporting the reed relay 10.

Figure 2:
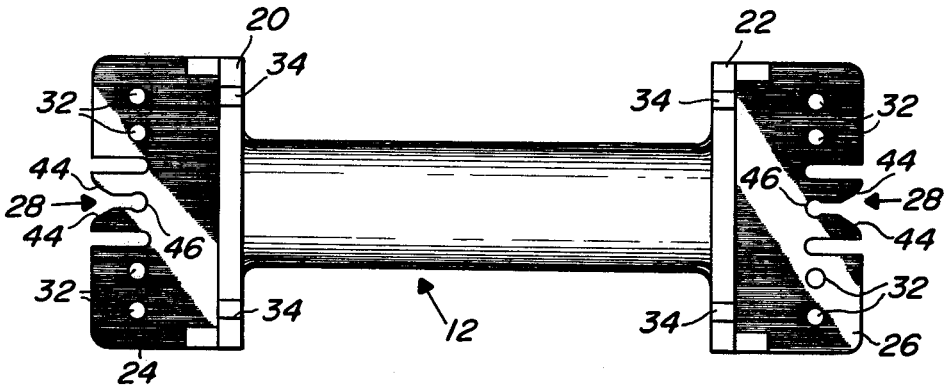
FIG. 2 is a top plan view of the bobbin of the reed switch relay shown in FIG. 1.

Each of the wire traps 28 has a pair of outwardly extending finger members 44 defining a keyhole shaped slot 46 best shown in FIG. 2. Although a keyhole shaped slot is shown in the drawings, it should be noted that other shaped slots may also be used, the exact shape of the slot being controlled by various factors such as the shape of the wire to be secured. The dimensions of the keyhole shaped slot 46 are chosen such that the diameter of the rounded portion of the keyhole shaped slot 46 is substantially equal to the diameter of the lead 15 of the reed switch 14. The space between the opposing planar surfaces of the keyhole shaped slot is slightly less than the dimaeter of the lead 15. The bobbin 12, and hence the members 44, are fabricated from a resilient plastic material, and are deflectable by the lead 15 as the lead 15 is being inserted into the keyhole shaped slot 46. When the lead 15 enters the curved portion of the keyhole shaped slot 46, the members 44 spring back to their original position and retain the lead 15 in place.

Figure 3:
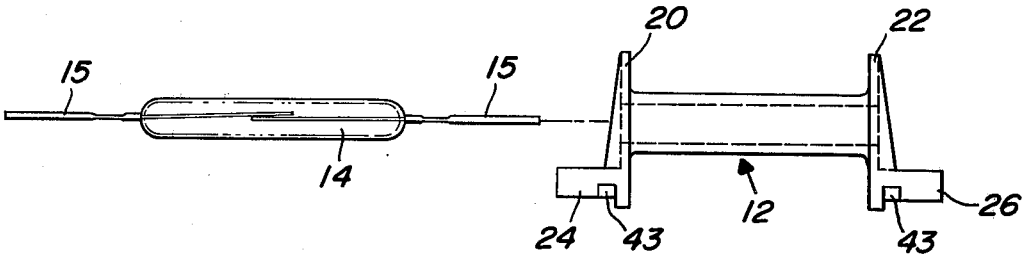
FIGS. 3, 4 and 5 are side elevation views of the reed switch and bobbin of the relay shown in FIG. 1 illustrating successive steps in the method of assembling the reed switch.
Figure 4:
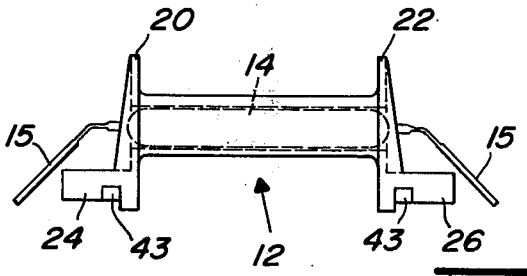
Figure 5:
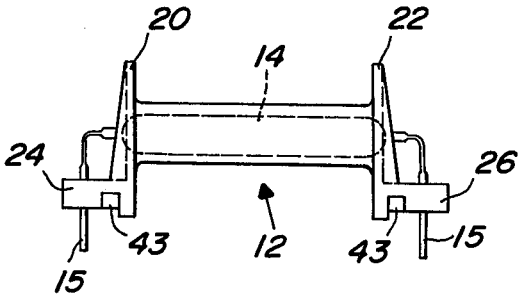

The assembly sequence of the reed switch relay 10 is best shown in FIGS. 3, 4 and 5. The leads 15 initially extend axially from the reed switch 14, thereby enabling the reed switch 14 to be inserted into the bobbin 12. After insertion, the leads 15 are bent downwardly to engage the wire trap 28. The initiation of the bending is shown in FIG. 4, and a suitable tool may be inserted between the leads 15 and the supporting legs 24 and 26 to prevent damage to the reed switch 14 during the bending operation. As the bending continues, the members 44 are forced apart by the leads 15 until the leads 15 have been bent downwardly at a 90° angle. At this point, the members 44 spring back to the original position to secure the leads 15 in place as shown in FIG. 5.

After the members 44 have sprung back to their original position, the leads 15 cannot escape inadvertantly from the curved region of the keyhole shaped slot 46 because the distance between the opposing planar surfaces of the keyhole shaped slot is insufficient to permit the passage of the leads 15. As a result, the leads 15 are trapped by the traps 28 and restrained in a vertical position. Because the leads 15 are held in the slots 46, forces applied to the leads 15 are absorbed or relieved by the wire traps 28 to prevent breakage of the reed switch 14. Furthermore, the wire traps 28 hold the leads 15 in position precisely enough to permit the leads 15 to be inserted directly into holes in a printed circuit board or into a socket. Finally, the leads 15 are secured well enough that forces arising from the insertion of the reed switch relay into a socket or printed circuit board do not cause damage to the reed switches 14.

Figure 6:
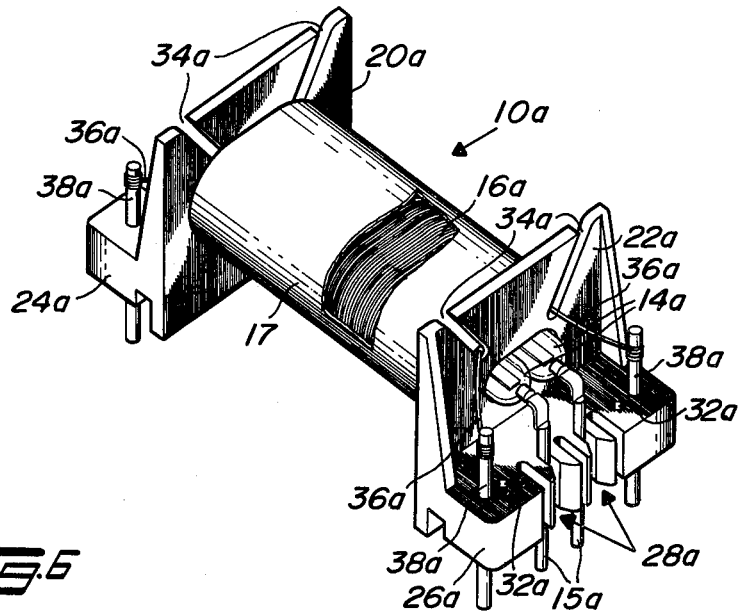
FIG. 6 is a perspective view of a two reed switch relay comprising an alternative embodiment of the invention.

The reed switch relay shown in FIG. 6 contains two reed switches to provide a double pole switch, the two switch embodiment being illustrated to show that the principles of the present invention may be applied to an embodiment having any number of switches. Analagous components in FIGS. 1 and 6 are designated by similar reference numerals, the reference numerals designating analagous components being followed by the suffix a in FIG. 6. The construction of the embodiment illustrated in FIG. 2 is similar to that of the embodiment shown in FIG. 1. In the embodiment shown in FIG. 2, a plurality of posts **36*a* and 38*a* are inserted into mounting legs 24*a* and 26*a*, respectively, and protrude downwardly from the lower surface of the mounting legs. Three posts 38*a* are employed in the embodiment of FIG. 6 for making electrical contact to two separate energizing windings within the coil 16*a* so that the reed switches may be energized from two separate sources. If a single winding is employed, as illustrated in FIG. 1, only two posts 38*a*** need be provided.

As in the case of FIG. 1, the leads extending from the switches **14*a* are bent downwardly at a 90° angle and secured by the wire traps 28*a*. The leads 15a extend downwardly from the mounting legs 24*a* and 26*a* and protrude an amount substantially equal to the protrusion of the mounting posts 38*a*. The downwardly extending mounting posts 38*a* and leads 15*a* serve as mounting pins and may be inserted into a printed circuit board or suitable socket to mechanically retain the reed switch relay 10*a*** in place.

Although the present invention has been described in conjunction with the embodiments illustrated in the accompanying drawings, it should be understood that modifications to the illustrated embodiments by one having skill in the art can be effected within the scope and spirit of the invention as defined in the appended claims.

What is claimed and desired to be secured by Letters Patent of the United States is:

1. A bobbin for a reed switch relay comprising:

a central portion having a longitudinal passageway defined therein for receiving a reed switch of the type having a pair of wire leads extending from opposite ends thereof;

a pair of supporting legs integrally molded with said central portion; and a pair of resilient wire retaining members integrally molded with each of said supporting legs in alignment with said passageway for retaining said wire leads therebetween.

2. A bobbin as recited in claim 1 wherein said resilient wire retaining members have a predetermined shape for defining a non-uniform width slot therebetween.

3. A bobbin as recited in claim 2 wherein said resilient wire retaining members define a keyhole shaped slot.

4. A bobbin as recited in claim 2 wherein said bobbin includes a pair of integrally molded flanges disposed on opposite sides of said central portion, and each of said flanges has a radially extending slot defined therein.

5. A reed switch relay comprising:

a bobbin having a central portion, a pair of supporting legs attached to opposite ends of said central portion and a pair of resilient wire retaining members integrally molded with each of said supporting legs, said central portion having a longitudinally extending passageway defined therein;

a reed switch disposed within said passageway, said reed switch having a pair of wire leads extending from opposite ends thereof engaging said wire retaining members; and an electromagnetic coil disposed about said central portion.

6. A reed switch relay as recited in claim 5 wherein said resilient wire retaining members each have a predetermined shape for defining a non-uniform width slot therebetween, said resilient retaining members each having an increased width central portion for retaining one of said wire leads.

7. A reed switch relay as recited in claim 6 wherein each of said resilient retaining members has a curved portion and a straight portion for defining a keyhole shaped slot therebetween.

8. A reed switch relay as recited in claim 6 wherein each of said resilient retaining members extends in a direction generally parallel to the longitudinal axis of said passageway and each of said wire leads intersects said retaining members at substantially a right angle.

9. A reed switch relay as recited in claim 8 further including a pair of flanges disposed on opposite ends of said central portion.

10. A reed switch relay as recited in claim 9 wherein said bobbin, said flanges, said supporting legs and said retaining members comprise an integrally molded assembly.

11. A reed switch relay as recited in claim 10 further including a post extending through one of said supporting legs and a wire extending from said electromagnetic coil electrically connected to said post, said flange having a slot defined therein for receiving said wire.

12. A reed switch relay as recited in claim 11 further including a cover supported by said flanges disposed over said bobbin.

* * * * *